US005647327A

United States Patent [19]

Enomoto et al.

[11] Patent Number: 5,647,327

[45] Date of Patent: Jul. 15, 1997

[54] INJECTION TIMING CONTROL DEVICE FOR FUEL INJECTION PUMP

[75] Inventors: Shigeiku Enomoto, Aichi-ken; Moriyasu Gotoh, Toyohashi, both of Japan

[73] Assignee: Nippon Soken, Inc., Nishio, Japan

[21] Appl. No.: 628,450

[22] Filed: Apr. 5, 1996

[30] Foreign Application Priority Data

Apr. 7, 1995 [JP] Japan ..... 7-107933
Dec. 11, 1995 [JP] Japan ..... 7-346431

[51] Int. Cl.[6] ..... F02M 37/04

[52] U.S. Cl. ..... 123/502

[58] Field of Search ..... 125/500, 501, 125/502

[56] References Cited

U.S. PATENT DOCUMENTS

| | | | |
|---|---|---|---|
| 4,557,240 | 12/1985 | Sakuranaka | 123/502 |
| 4,593,669 | 6/1986 | Igarashi et al. | 123/502 |
| 4,610,234 | 9/1986 | Sukuranaka | 123/502 |
| 5,125,802 | 6/1992 | Nakamura et al. | 123/502 |

FOREIGN PATENT DOCUMENTS

| | | |
|---|---|---|
| 63-110640 | 7/1988 | Japan . |
| 53-32170 | 12/1993 | Japan . |

*Primary Examiner*—Thomas N. Moulis
*Attorney, Agent, or Firm*—Cushman Darby & Cushman IP Group of Pillsbury Madison & Sutro, LLP

[57] ABSTRACT

An injection timing control device for a fuel injection pump includes a timer cylinder and a timer piston slidably received in the timer cylinder to define a high-pressure chamber and a low-pressure chamber at opposite axial ends thereof. The high-pressure chamber communicates with a high pressure side, while the low-pressure chamber communicates with a low pressure side and is provided therein with a spring for biasing the timer piston toward the high-pressure chamber. A servo valve having a spool is further provided. Communication between the high-pressure and low-pressure chambers is allowed or prohibited depending on movement of the spool of the servo valve. When the communication is allowed, a fuel pressure in the high-pressure chamber is released into the low-pressure chamber so that the timer piston moves toward the high-pressure chamber due to a biasing force of the spring. This movement of the timer piston is transmitted to a roller ring to retard a fuel injection timing. On the other hand, when the communication is prohibited, the piston moves in the opposite direction so that the fuel injection timing is advanced.

22 Claims, 10 Drawing Sheets

INJECTION TIMING CONTROL DEVICE FOR FUEL INJECTION PUMP

BACKGROUND OF THE INVENTION

1. Field of the Invention

The present invention relates to an injection timing control device for a fuel injection pump, and more specifically, to an improvement in structure of an injection timing control device for a fuel injection pump where a fuel injection timing is variable.

2. Description of the Prior Art

In distributor type fuel injection pumps for use in the diesel engines or the like, a plunger is rotated by means of a drive shaft rotating synchronously with the engine, so as to achieve switching among engine cylinders for a subsequent fuel injection. Further, following the rotation of the drive shaft, convex portions of a face cam at the base end of the plunger ride on rollers of a roller ring to advance the plunger so that fuel is fed under pressure to a corresponding fuel injection valve from a fuel pressure chamber and thus the fuel injection into the corresponding engine cylinder is started. Changing of the fuel injection timing is achieved by moving a timer piston coupled to the roller ring, depending on a pressure of fuel from a fuel feed pump, so as to rotate the roller ring to change positions of the rollers. Japanese First (unexamined) Utility Model Publication No. 63-110640 shows such a fuel injection timing control device for a fuel injection pump. Japanese First (unexamined) Patent Publication No. 5-332170 further proposes a fuel injection timing control device for a fuel injection pump, which aims to prevent the partial abrasion of a servo valve which moves depending on the fuel pressure from the fuel feed pump to control a position of the timer piston.

On the other had, reflecting the recent highly advanced engine control technique, those fuel injection timing control devices have been available, wherein the fuel injection timing can be adjusted desirably according to a required engine control. FIG. 10 shows one example of such fuel injection timing control devices. In FIG. 10, a timer cylinder 94 is provided in a housing 92 under a roller ring 91. The timer cylinder 94 is dosed at its opposite axial ends and communicates with a connecting opening 93 which further communicates with a fuel chamber. A timer piston 95 is slidably received in the timer cylinder 94. The roller ring 91 is connected to the timer piston 95 via a slide pin 991 extending from the roller ring 91 and a spherical bearing 992 which is rotatable in the timer piston 95. When the timer piston 95 moves rightward and leftward in the figure, the roller ring 91 rotates in normal and reverse directions. A timer high-pressure chamber **94*b* communicates with the connecting opening 93 via a passage 951 formed in the timer piston 95 so as to receive the fuel at about 5 atm. from the fuel chamber via a flow restrictor 952 provided in the passage 951. On the other had, a timer low-pressure chamber 94*a* communicates with an inlet port of a fuel feed pump (not shown) via a passage 98 so as to be constantly held at the atmospheric pressure. In the timer low-pressure chamber 94*a* is disposed a spring 953 for biasing the timer piston 95 toward the timer high-pressure chamber 94*b***.

Further, a passage 96 is provided under the timer cylinder 94 for establishing communication between the timer high-pressure chamber **94*b* and the timer low-pressure chamber 94*a*. An oil-pressure control valve 97 is further provided to control a flow rate of the fuel flowing in the passage 96 so as to adjust a fuel pressure in the timer high-pressure chamber 94*b*. The timer piston 95 is controlled to a position where the fuel pressure in the timer high-pressure chamber 94*b* and the sum of the fuel pressure in the timer low-pressure chamber 94*a* and the biasing force of the spring 953 are balanced. The control of the oil-pressure control valve 97 is achieved by changing a duty cycle of a pulse signal at, for example, 40 Hz, that is, by changing a rate of time period of energization to the oil-pressure control valve 97**.

Following the strengthening of exhaust gas regulation, the demand has been increased for a wider range of fuel injection timing variation, stabilization of the fuel injection timing, and improvement in response characteristic for changing the fuel injection timing.

SUMMARY OF THE INVENTION

Therefore, it is an object of the present invention to provide an improved injection timing control device for a fuel injection pump.

According to one aspect of the present invention, an injection timing control device for a fuel injection pump comprises a piston slidably received in a cylinder and having at least one end surface for receiving thereon a pressurized fuel in a pressure chamber communicating with an outlet side of a fuel feed pump; a servo valve having a spool, the spool communicating with the pressure chamber and controlling a fuel pressure in the pressure chamber so as to move the piston; spool operating means for operating the spool; and fuel injection means, mechanically connected to the piston, for changing a fuel injection timing depending on a moved distance of the piston.

It may be arranged that the fuel injection means comprises a roller ring having a roller and rotated depending on the moved distance of the piston, and a plunger having a face cam at its base end and rotated by a drive shaft, the plunger achieving an advancing operation every time the face cam rides on the roller of the roller ring, for feeding the fuel under pressure to a fuel injection valve.

It may be arranged that the pressure chamber is provided at each of opposite ends of the piston, that a spring for biasing the piston is provided in one of the pressure chambers, and that the fuel pressure in the one of the pressure chambers is controlled by the servo valve.

It may be arranged that the one of the pressure chambers communicate with an inlet side of the fuel feed pump via flow restricting means.

It may be arranged that the pressure chamber is provided only at one end of the piston, that a low-pressure chamber is provided at the other end of the piston, the low-pressure chamber communicating with an inlet side of the fuel feed pump so as to be constantly held at a given low pressure, and that a spring is provided in the low-pressure chamber for biasing the piston toward the pressure chamber.

It may be arranged that the piston is formed with a slide hole for slidably receiving therein the spool of the servo valve, and that the servo valve opens and closes a passage communicating with the pressure chamber by movement of the spool in the slide hole.

It may be arranged that a check valve is provided in a passage communicating with the pressure chamber for preventing the fuel from flowing out from the pressure chamber.

It may be arranged that the spool operating means comprises another pressure chamber communicating with an inlet side of the fuel feed pump via flow restricting means, a pressure control valve for controlling a fuel pressure in the another pressure chamber, and a push rod having a diameter smaller than that of the piston and urged by the pressurized fuel in the another pressure chamber to move in its axial direction so as to push the spool at its tip.

It may be arranged that a port open area of the pressure control valve is set smaller than that of the servo valve.

It may be arranged that the spool operating means comprises a push rod operated by a motor to move in its axial directions, and that the spool is operated by a tip of the push rod.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings. Throughout the figures showing the preferred embodiments, the same signs or symbols represent the same or like components.

First Embodiment

Figure 1:
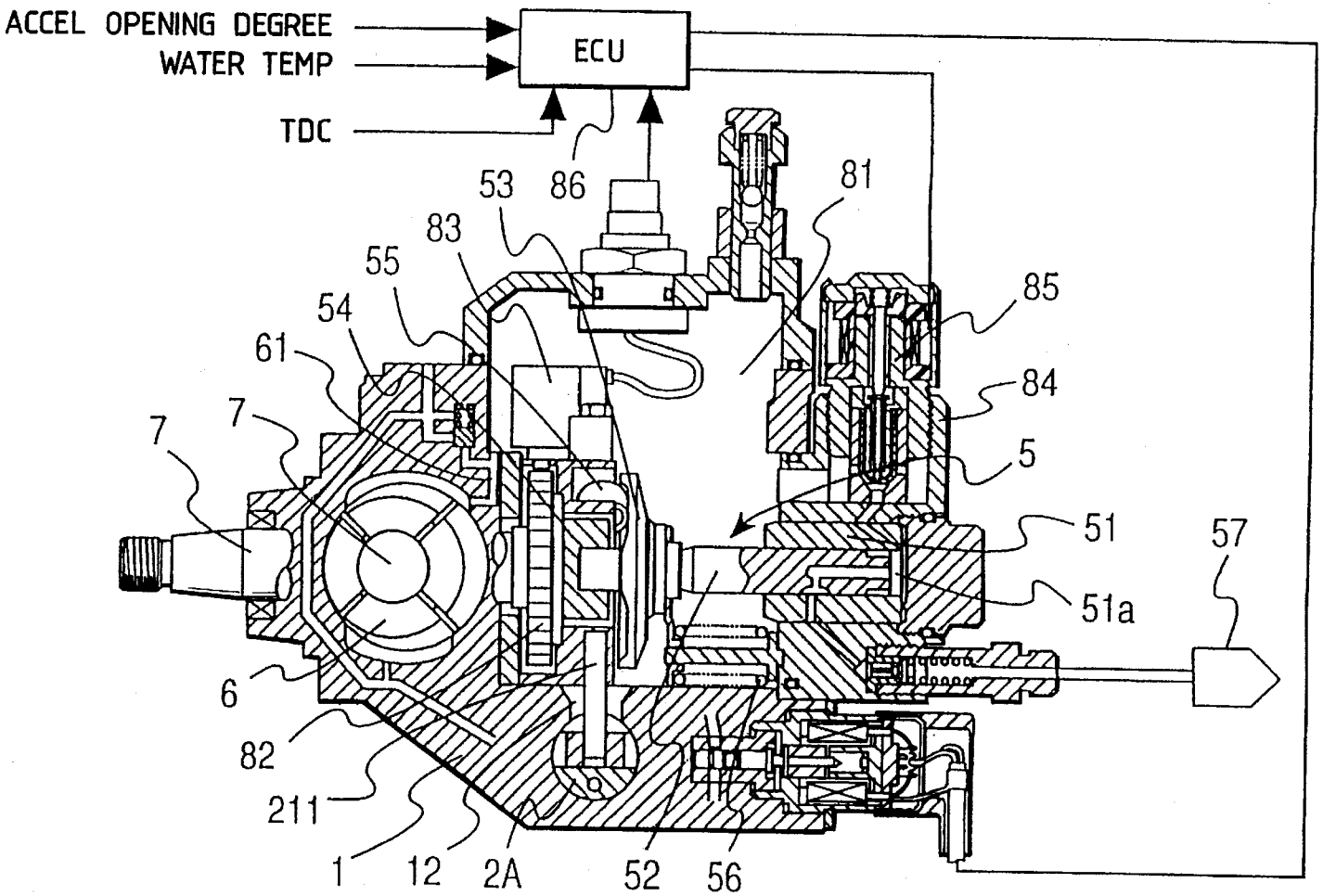
FIG. 1 is a sectional view showing a fuel injection pump incorporating therein an injection timing control device according to a first preferred embodiment of the present invention.

An injection timing control device for a fuel injection pump according to a first preferred embodiment of the present invention will be described hereinbelow:

In FIG. 1, a drive shaft 7 is coupled to and driven by an engine (not shown) to rotate at a speed which is half a speed of the engine. A signal rotor 82 is coaxially mounted on the drive shaft 7 and formed with a plurality of teeth on the circumference thereof. A speed sensor 83 is provided confronting the toothed circumference of the signal rotor 82. The speed sensor 83 produces a pulse signal depending on the rotational speed of the drive shaft 7 and thus the engine speed by means of the electromagnetic induction caused by the teeth of the signal rotor 82 and outputs it to an electronic control unit (ECU) 86. To the drive shaft 7 are coupled a face cam 53 which drives a plunger 52 for feeding the fuel under high pressure, and a vane-type fuel feed pump 6 which feeds the fuel to the fuel injection pump from a fuel tank (not shown). The face cam 53 is integrated with the plunger 52 and pressed against rollers 55 of a roller ring 54 by means of a spring 56.

When the face cam 53 is rotated by the drive shaft 7, convex portions of the face cam 53 ride on and off the rollers 55 so that the face cam 53 together with the integrated plunger 52 makes the rotational reciprocating motion along an axis of the plunger 52. The plunger 52 is received in a cylinder bore of a pump cylinder 51 and defines a high-pressure chamber 51*a* at its tip. The volume of the high-pressure chamber 51*a* is increased and decreased due to the reciprocating motion of the plunger 52 while inlet and outlet ports opened to the high-pressure chamber 51*a* are switched due to the rotational motion of the plunger 52. The fuel pressurized approximately at 5 atm. and discharged from an outlet port 61 of the fuel feed pump 6 is stored in a fuel chamber 81. The fuel stored in the fuel chamber 81 is sucked into the high-pressure chamber 51*a* during a retreating stroke (leftward in FIG. 11 of the plunger 52 and pressurized to a high pressure during an advancing stroke (rightward in FIG. 1) of the plunger 52 so as to be fed to a corresponding fuel injection valve 57 where the pressurized fuel is injected into a corresponding combustion chamber (not shown) of the engine. A solenoid spill valve 85 is provided in a subhousing 84 of the fuel injection pump for releasing the pressure in the high-pressure chamber 51*a*. By controlling opening and closing operations of the solenoid spill valve 85 by means of the ECU 86, a fuel injection quantity and a fuel injection rate can be controlled.

The roller ring 54 has an outer ring portion which is allowed to turn within a given angular range with respect to an axis of the drive shaft 7. With this angular displacement, the rollers 55 move in a circumferential direction of the roller ring 54. Thus, a timing when each convex portion of the face cam 53 rides on the roller 55 is changed so that the fuel injection timing of the fuel injection pump is changed.

The foregoing speed sensor 83 is fixed on the outer ring portion of the roller ring 54. An output signal of the speed sensor 83 is inputted to the ECU 86. As shown in FIG. 1, the ECU 86 is further inputted with, for example, a signal indicative of top dead center (TDC) of the engine, a signal indicative of accel opening degree representing an engine load, and a signal indicative of engine coolant temperature.

Figure 2:
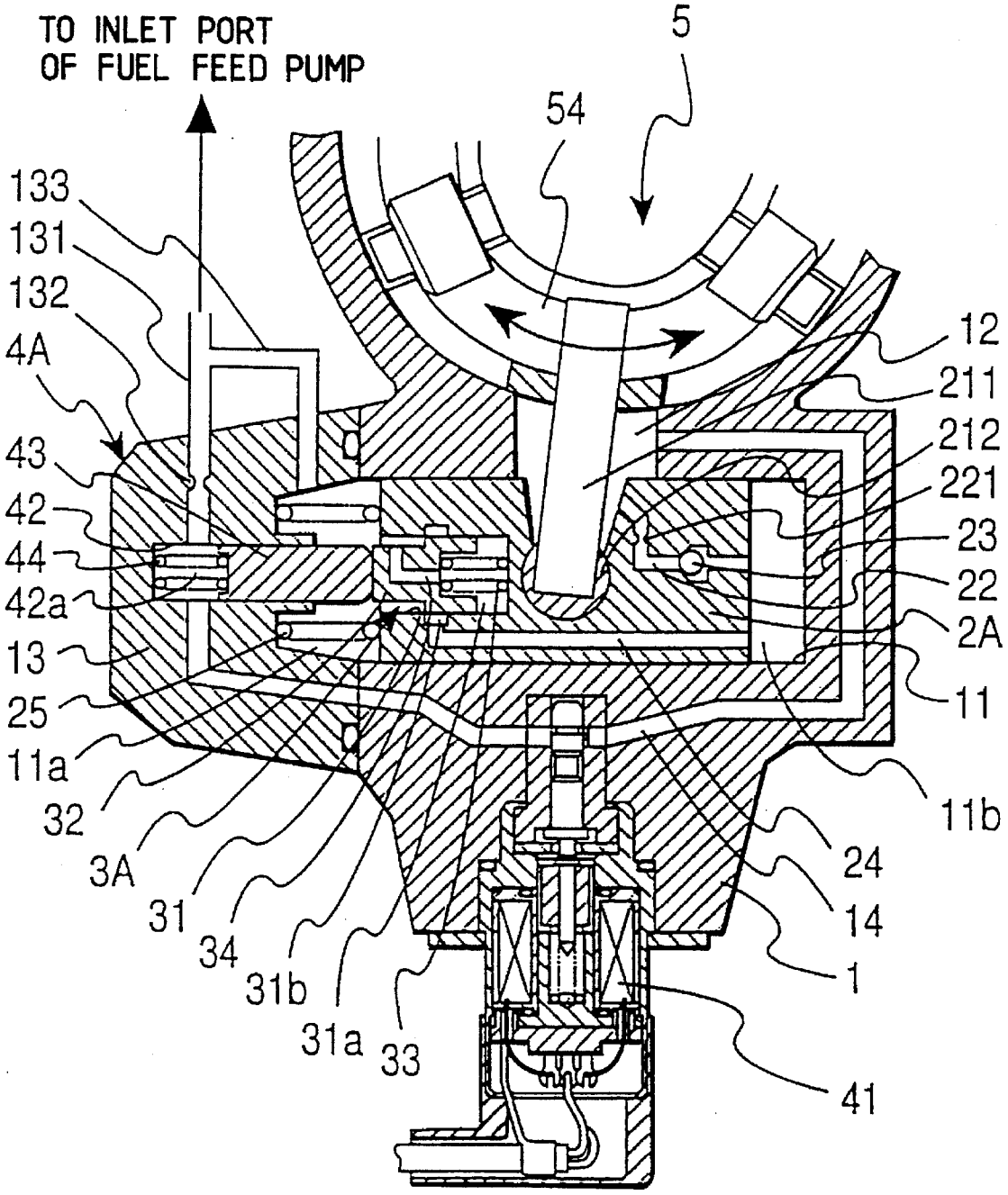
FIG. 2 is a sectional view showing a roller ring drive section of the injection timing control device according to the first preferred embodiment.
Figure 3:
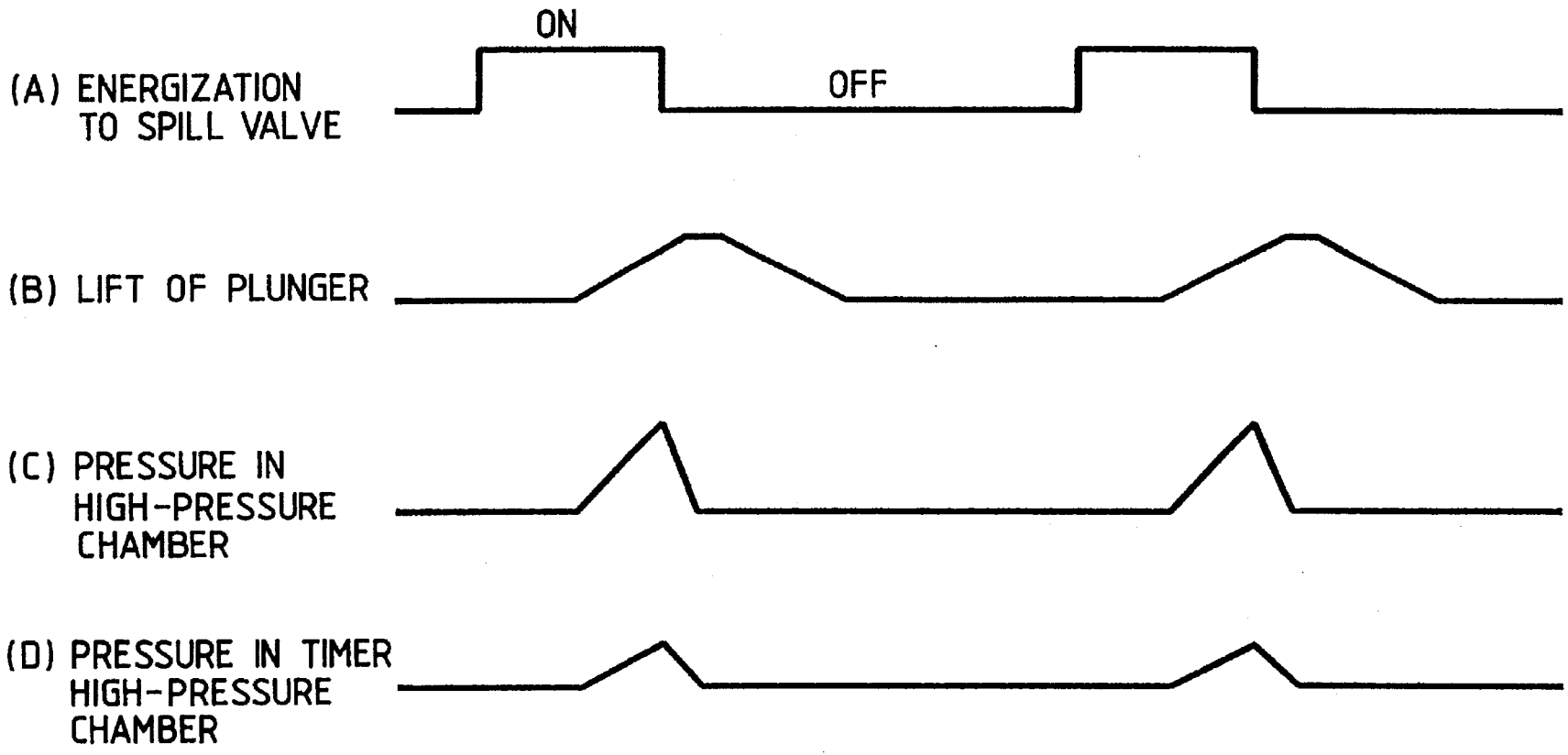
FIG. 3 is a time chart for explaining an operation of the fuel injection pump according to the first preferred embodiment.

FIG. 2 shows details of a roller ring drive section for controlling the angular displacement of the roller ring 54 and thus the rollers 55. In the figure, a housing 1 includes therein a timer cylinder 11 which extends in a direction orthogonal to the drive shaft 7 (see FIG. 1). The timer cylinder 11 receives therein a timer piston 2A which is slidable right and left in FIG. 2 or along the length of the timer cylinder 11. One end of the-timer cylinder 11 at the left end of the timer piston 2A is closed by a timer cover 13. In the center of the timer piston 2A, a spherical bearing 212, working as a connecting member, is rotatably disposed. Into the spherical bearing 212 is fixedly fitted one end of a slide pin 211 which also works as a connecting member and extends from the roller ring 54 via a connecting opening 12. With this arrangement, depending on the rightward/leftward movement of the timer piston 2A in the timer cylinder 11, the roller ring 54 rotates in a normal (forward) or reverse (backward) direction via the spherical bearing 212 and the slide pin 211.

In the timer cylinder 11, a timer low-pressure chamber 11*a* and a timer high-pressure chamber 11*b* are formed so as to face opposite axial end surfaces (right and left end surfaces in FIG. 2) of the timer piston 2A, respectively. In the timer low-pressure chamber 11*a* is disposed a timer spring 25 so as to bias the timer piston 2A toward the timer high-pressure chamber 11*b* (rightward in FIG. 2). The timer piston 2A is integrally provided with a servo valve 3A. The servo valve 3A includes a spool 32 slidably received in a slide hole 31 which is formed in the timer piston 2A at the left end portion thereof and opens to the timer low-pressure chamber 11*a*. The spool 32 is biased toward the timer low-pressure chamber 11*a* (leftward in FIG. 2) by means of a spring 33 disposed in a spring chamber 31*a*. The spool 32 is of a stepped shape having a small-diameter portion and a large-diameter portion. The spool 32 is formed therein with a passage 34 which extends from the spring chamber 31*a* to open at the small-diameter portion of the spool 32 so as to establish communication between the spring chamber 31*a* and the timer low-pressure chamber 11*a* via the inside of the spool 32. The outer periphery of the large-diameter portion of the spool 32 is in abutment with the inner periphery of the slide hole 31 so as to open and close an annular groove 31*b* formed on the inner periphery of the slide hole 31. The annular groove 31*b* communicates with the timer high-pressure chamber 11*b* via a passage 24. An open area of a port of the servo valve 3A formed between the annular groove 31*b* and the spool 32 is set relatively large.

The timer piston 2A is further formed therein at its right end portion with a passage 22 having therein a flow restrictor 221. The passage 22 provides communication between the connecting opening 12 and the timer high-pressure chamber 11*b*. A check valve 23 is provided in the passage 22 for allowing the flow of fuel only from the fuel chamber 81 to the timer high-pressure chamber 11*b*.

The timer cover 13 is formed therein with a horizontal cylinder 42 having a smaller diameter than the timer cylinder 11. A push rod 43 is slidably received in the cylinder 42 so as to stay in abutment with a left end surface of the spool 32 at its tip. At the back side of the push rod 43 is arranged a spool control pressure chamber 42*a* where a spring 44 with a small biasing force is disposed so as to urge the push rod 43 toward the spool 32 (rightward in FIG. 2). The spool control pressure chamber 42*a* communicates, on one hand, with the connecting opening 12 via a passage 14 which is opened and closed by means of an oil-pressure control valve 41, and on the other hand, with a low pressure side, that is, an inlet port of the fuel feed pump 6 (see FIG. 1), via a passage 131 with a flow restrictor 132 provided therein. Further, a passage 133 extending from the timer low-pressure chamber 11*a* joins the passage 131 downstream of the flow restrictor 132. The oil-pressure control valve 41 is in the form of a solenoid valve which is subjected to a duty-cycle control by the ECU 86. An open area of a port of the oil-pressure control valve 41 is set smaller than the foregoing open area of the port of the servo valve 3A.

Now, operations of the fuel injection pump and the injection timing control device having the foregoing structures will be described with reference to FIGS. 1 to 5. During the retreating stroke of the plunger 52, the fuel in introduced into the high-pressure chamber 51*a*. Then, the solenoid spill valve 85 is energized at a given timing (see (A) in FIG. 3). Subsequently, the convex portions of the face cam 53 at the base end of the plunger 52 ride on the rollers 55 of the roller ring 54 following the rotation of the drive shaft 7 so that the plunger 52 advances to compress the fuel (see (B) in FIG. 3). Thus, the fuel is fed under pressure from the high-pressure chamber 51*a* to the corresponding fuel injection valve 57 so that a fuel injection into the corresponding engine cylinder (not shown) is started. During feeding of the fuel under pressure, the pressure in the high-pressure chamber 51*a* is high due to the compressed fuel (see (C) in FIG. 3) so that a torque reaction force is applied to the rollers 55 from the plunger 52. On this occasion, since the spool 32 of the servo valve 3A is not subjected to the torque reaction force a position of the spool 32 is kept constant regardless of the torque reaction force. Thus, fluctuation in position of the timer piston 2A whose position is controlled by the spool 32, can be suppressed to be small so that the fuel injection timing is stabilized.

In case of increasing a fuel injection pressure for coping with the strengthening of exhaust gas regulation, the pressure in the high-pressure chamber 51*a* is set high so that the torque reaction force is also intensified. This intensified reaction force is exerted on the timer piston 2A from the roller ring 54 via the slide pin 211 and the spherical bearing 212 as a biasing force to urge the timer piston 2A toward the timer high-pressure chamber 11*b*. Thus, the pressure in the timer high-pressure chamber 11*b* is increased due to the biased timer piston 2A (see (D) in FIG. 3). This causes a reverse flow of the fuel from the timer high-pressure chamber 11*b* toward the connecting opening 12 via the passage 22 formed in the timer piston 2A. However, the fuel in the timer high-pressure chamber 11*b* is prevented from flowing out via the passage 22 due to the check valve 23. Accordingly, the position of the timer piston 2A is not changed so that the fuel injection timing is stabilized. Thus, the increase in fuel injection pressure corresponding to the strengthening of exhaust gas regulation can also be fully coped with. On the other hand, to be exact, when the high-pressure chamber 51*a* is under high pressure, it may be possible that the timer piston 2A moves toward the timer high-pressure chamber 11*b* by a slight distance corresponding to compression of the fuel in the timer high-pressure chamber 11*b*. In this case, however, since the timer piston 2A is arranged to move in a direction to close the annular groove 31*b*, flowing-out of the fuel via the annular groove 31*b* can be reliably prevented so that the fuel injection timing is stabilized.

Figure 4:
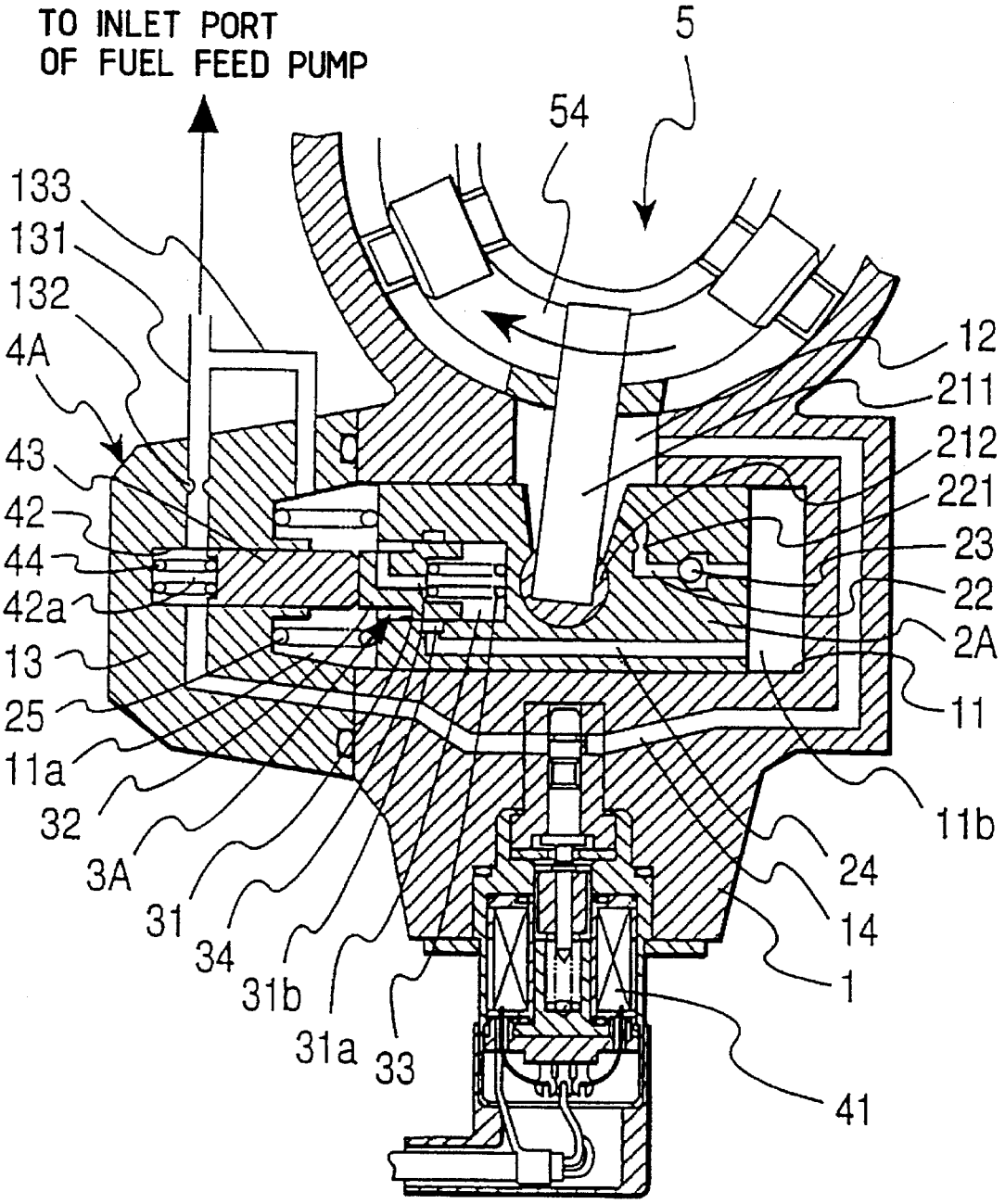
FIGS. 4 and 5 are sectional views, respectively, of a roller ring drive section for explaining an operation of the injection timing control device according to the first preferred embodiment.

For advancing the fuel injection timing, a duty cycle for opening the oil-pressure control valve 41 is set smaller. With this arrangement, the pressure in the spool control pressure chamber 42*a* is lowered so that the spool 32 and the push rod 43 move toward the spool control pressure chamber 42*a* due to the biasing force of the spring 33, thereby fully closing the annular groove 31*b* as shown in FIG. 4. As a result, the pressure in the timer high-pressure chamber 11*b* increases toward the pressure in the connecting opening 12, that is, the pressure in the fuel chamber 81 so that the timer piston 2A moves toward the timer low-pressure chamber 11*a* against the biasing force of the timer spring 25. Following this, the roller ring 54 turns in the clockwise direction as shown by an arrow in FIG. 4 to advance the fuel injection timing. When the timer piston 2A moves by a distance substantially equal to the movement of the spool 32 so as to open again the annular groove 31*b*, the pressures applied to the opposite axial end surfaces of the timer piston 2A are balanced, where the timer piston 2A is stopped.

Figure 5:
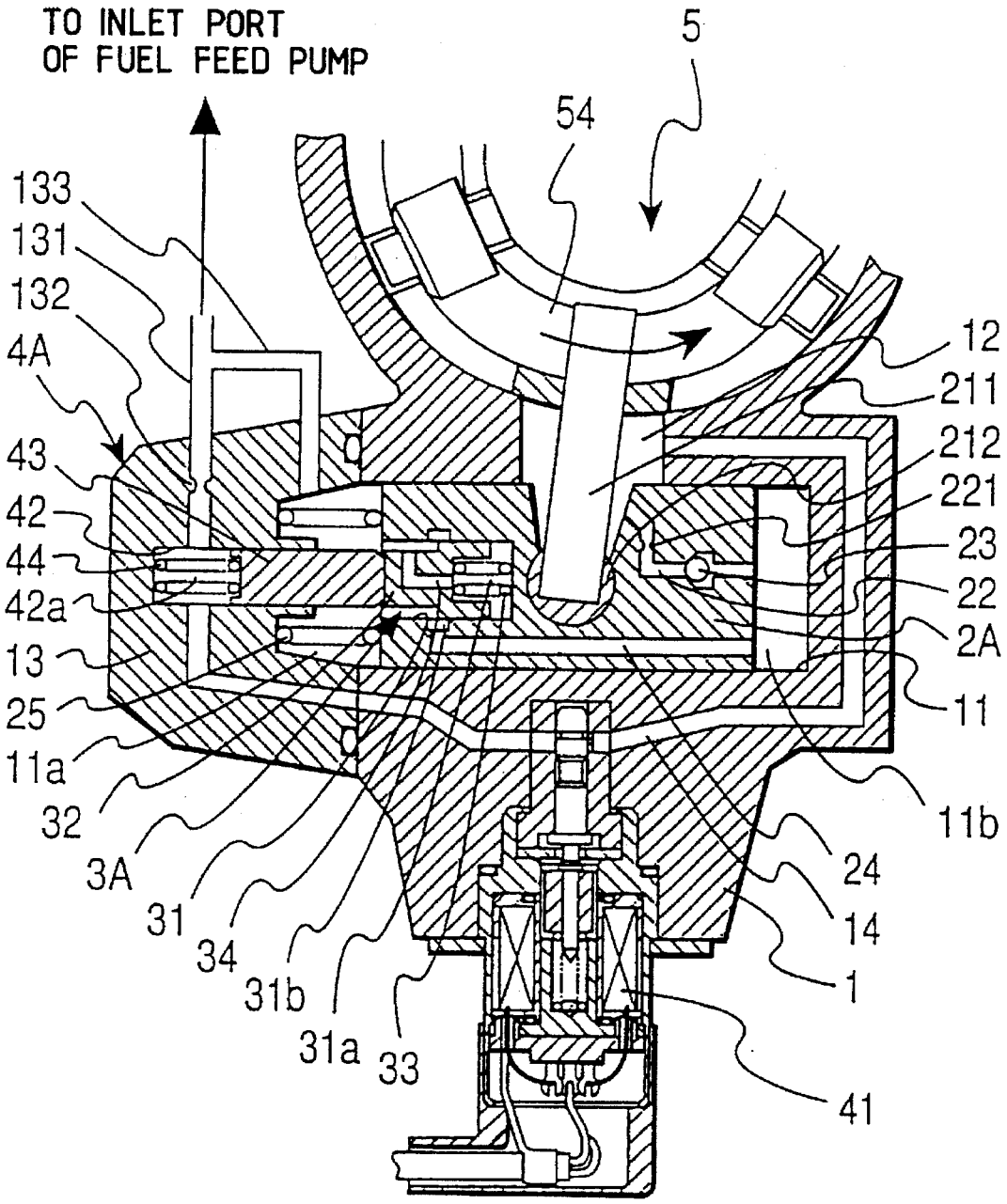

On the other hand, for retarding the fuel injection timing, a duty cycle for opening the oil-pressure control valve 41 is set larger. With this arrangement, the pressure in the spool control pressure chamber 42*a* increases toward the pressure in the connecting opening 12, that is, the pressure in the fuel chamber 81, so that the push rod 43 pushes the spool 32 to move toward the spring chamber 31*a* (rightward in FIG. 4) against the biasing force of the spring 33. Accordingly, as shown in FIG. 5, the annular groove 31*b* is largely opened to allow the fuel in the timer high-pressure chamber 11*b* to flow toward the timer low-pressure chamber 11*a* via the passage 24 so that the pressure in the timer high-pressure chamber 11*b* is lowered. As a result, the timer piston 2A moves toward the timer high-pressure chamber 11*b* due to the biasing force of the timer spring 25. Thus, the roller ring 54 turns in the counterclockwise direction as shown by an arrow in FIG. 5 to retard the fuel injection timing. When the timer piston 2A moves by a distance substantially equal to the movement of the spool 32 to open the annular groove again to a certain proper degree, the pressures applied to the opposite axial end surfaces of the timer piston 2A are balanced, where the timer piston 2A is stopped.

As described above, according to the foregoing first preferred embodiment, the pressure in the spool control pressure chamber 42*a* is controllably changed by means of the oil-pressure control valve 41 so as to desirably change the position of the spool 32 of the servo valve 3A, and further, the timer piston 2A is arranged to follow the spool 32. With this arrangement the fuel injection timing can be reliably advanced or retarded over a wide range. Further, by providing the check valve 23 in the passage 22 connecting the timer high-pressure chamber 11*b* and the connecting opening 12, the fuel injection timing can be further stabilized. Moreover, since the volume of the spool control pressure chamber 42*a* at the back side of the push rod 43 can be set small, the pressure in the spool control pressure chamber 42*a* can be quickly changed even by means of the oil-pressure control valve 41 having a small port open area. Since the fuel flow is controlled by means of the servo valve 3A having a large port open area and operated depending on the pressure in the spool control pressure chamber 42*a*, the timer piston 2A is operated speedily so that the fuel injection timing can be changed quickly via the roller ring 54.

Second Embodiment

Figure 6:
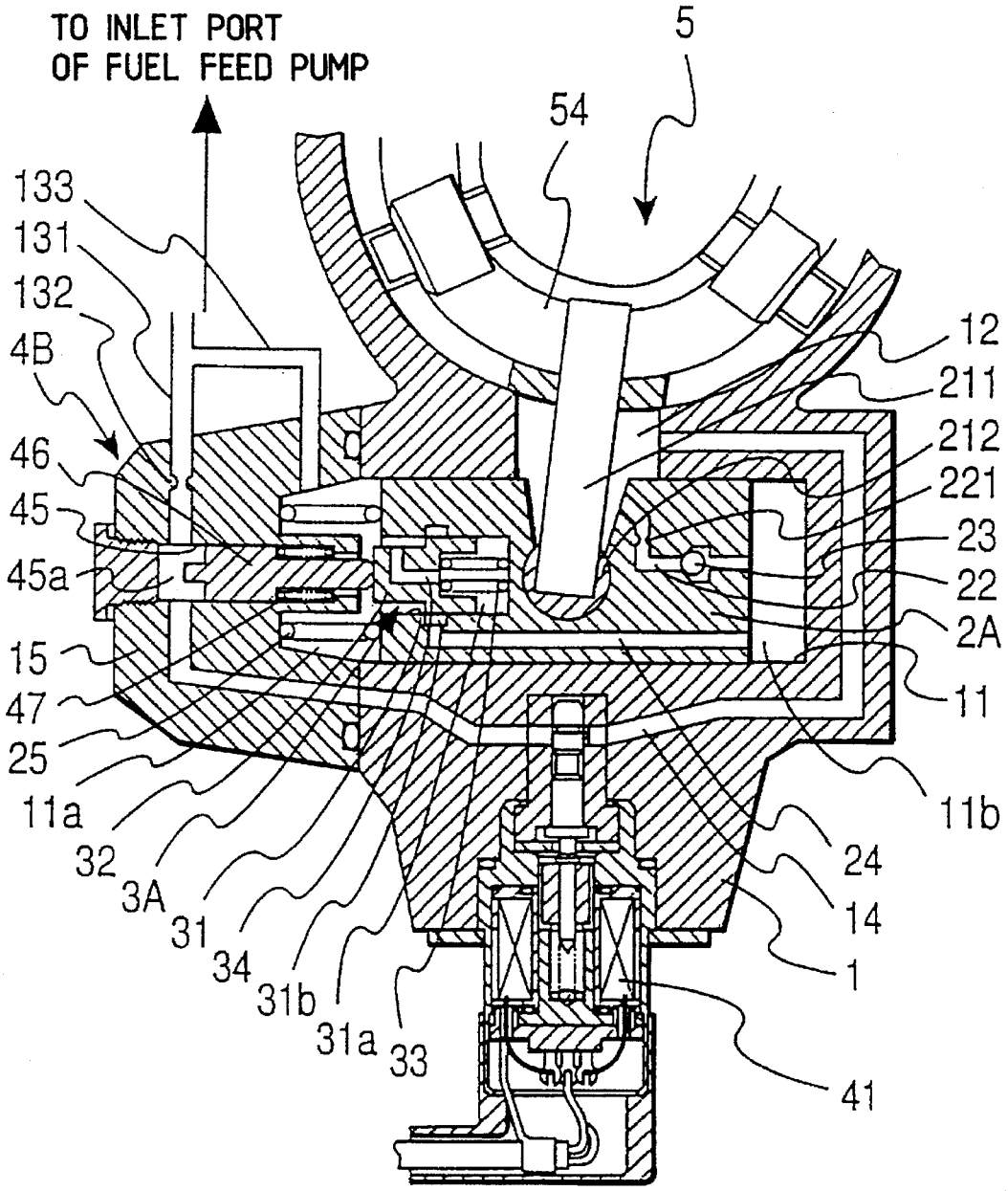
FIG. 6 is a sectional view showing a roller ring drive section of an injection timing control device for a fuel injection pump according to a second preferred embodiment of the present invention.

Now, a second preferred embodiment of the present invention will be described hereinbelow:

In the foregoing first preferred embodiment, since the relatively large biasing force of the spring 33 provided in the slide hole 31 of the servo valve 3A changes depending on a positional relationship between the spool 32 and the timer piston 2A, the load applied to the push rod 43 also changes. In view of this, in the second preferred embodiment, the spool operating means 4A in FIG. 2 is replaced by spool operating means 4B as shown in FIG. 6. The other structure is substantially the same as that in the first preferred embodiment. The following explanation mainly concerns what differs from the first preferred embodiment.

As shown in FIG. 6, a push rod 46 having a smaller-diameter portion at its tip side is received in a cylinder 45 formed in a timer cover 15. A spring 47 having a relatively large biasing force is disposed around the smaller-diameter portion of the push rod 46 so as to urge the push rod 46 in a direction away from the spool 32. In a spool control pressure chamber 45*a* at the back side of the push rod 46 is provided no spring, as corresponding to the spring 44 in the first preferred embodiment, for urging the push rod toward the spool 32. By providing the spring 47, the biasing force of the spring 33 of the servo valve 3A can be set smaller so that the change in load applied to the push rod 46 and the spool 32 due to expansion or retraction of the spring 33 upon movement of the timer piston 2A can be suppressed to be small.

In this preferred embodiment, no spring is provided in the spool control pressure chamber 45*a*, but a proper spring may be provided in the spool control pressure chamber 45*a*.

Third Embodiment

Figure 7:
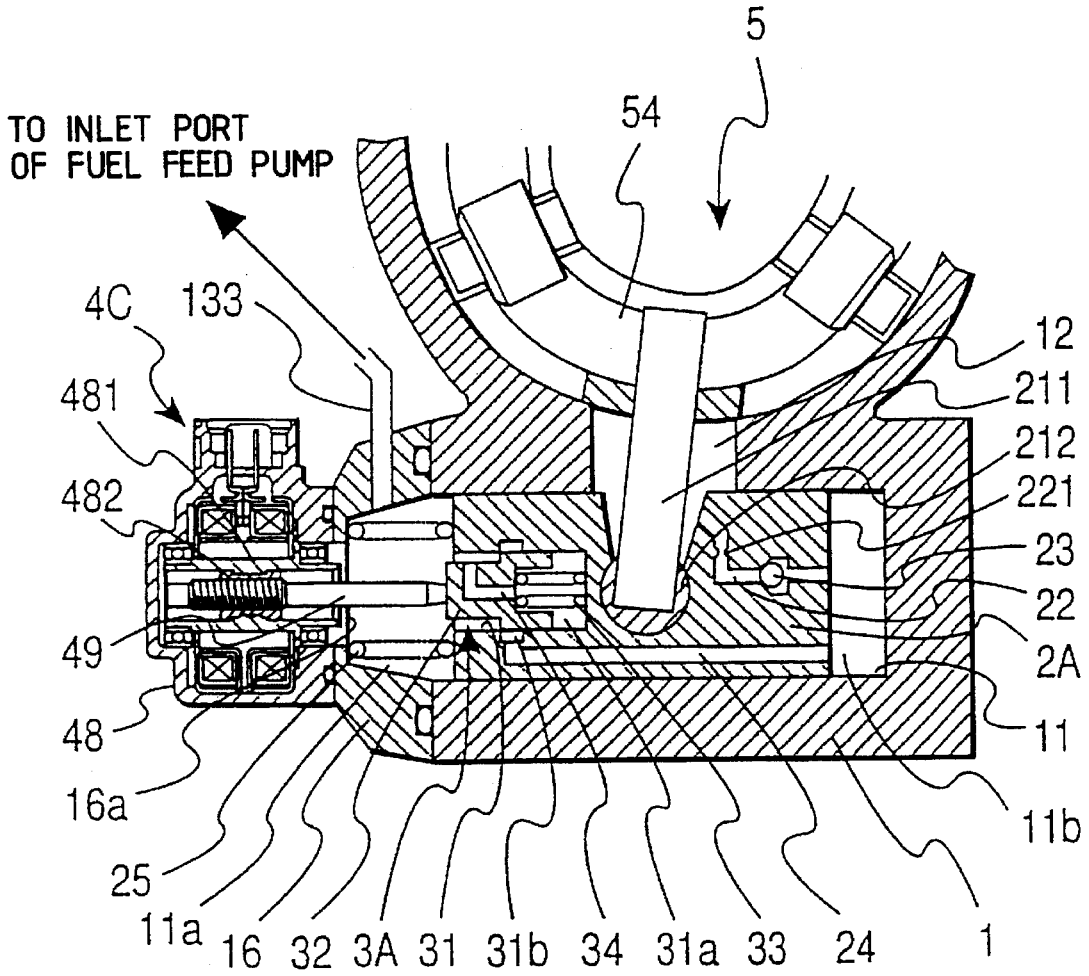
FIG. 7 is a sectional view showing a roller ring drive section of an injection timing control device for a fuel injection pump according to a third preferred embodiment of the present invention.

Now, a third preferred embodiment of the present invention will be described hereinbelow:

In each of the foregoing first and second preferred embodiments, the oil pressure in the spool control pressure chamber 42*a*, 45*a* which determines a position of the spool 32 of the servo valve 3A, is decided based on a fuel quantity flowing in via the oil-pressure control valve 41 and a fuel quantity flowing out via the passage 131 passing the flow restrictor 132. However, each of such fuel quantities changes depending on a temperature of the fuel. Accordingly, for improving the control accuracy of the fuel injection timing, it is necessary to perform a feedback control of the opening duty cycle so as to converge the actual fuel injection timing toward the target fuel injection timing. In view of this, in the third preferred embodiment, the spool operating means 4A or 4B in FIG. 2 or 6 is replaced by spool operating means 4C as shown in FIG. 7. The other structure is substantially the same as that in the first or second preferred embodiment. The following explanation mainly concerns what differs from the first or second preferred embodiment.

As shown in FIG. 7, a timer cover 16 corresponding to the timer cover 13 or 15 is formed with an opening 16*a* confronting the timer low-pressure chamber 11*a* or the axial end surface of the timer piston 2A at this side. A stepping motor 48 is fixed to the timer cover 16 in such a manner as to keep the hermetic condition of the timer low-pressure chamber 11*a*. A push rod 49 extending from the stepping motor 48 passes the opening 16*a* so as to abut the left end surface of the spool 32 at its tip.

An essentially cylindrical rotor 481 of the stepping motor 48 coaxially and firmly receives therein a screw 482 having a threaded inner surface. The push rod 49 has a threaded base side passing through and meshed with the screw 482 and is arranged to move right-wad or leftward in FIG. 7, that is, advance or retreat relative to the spool 32, depending on the normal or reverse rotation of the rotor 481. Thus, the position of the spool 32 is determined and held by the push rod 49 and the spring 33.

The rotation of the rotor 481 of the stepping motor 48 is controlled by the ECU 86 (see FIG. 1) based on a pulse signal. Specifically, since the rotor 481 precisely rotates by an angle corresponding to the number of pulses, the push rod 49 can be precisely positioned depending on the number of rotations of the rotor 481 and the rotation angle thereof. With this arrangement, the fuel injection timing can be controlled accurately without being affected by the temperature of the fuel. The fuel injection timing control may be achieved simply based on the open-loop control rather than the feedback control.

Fourth Embodiment

Figure 8:
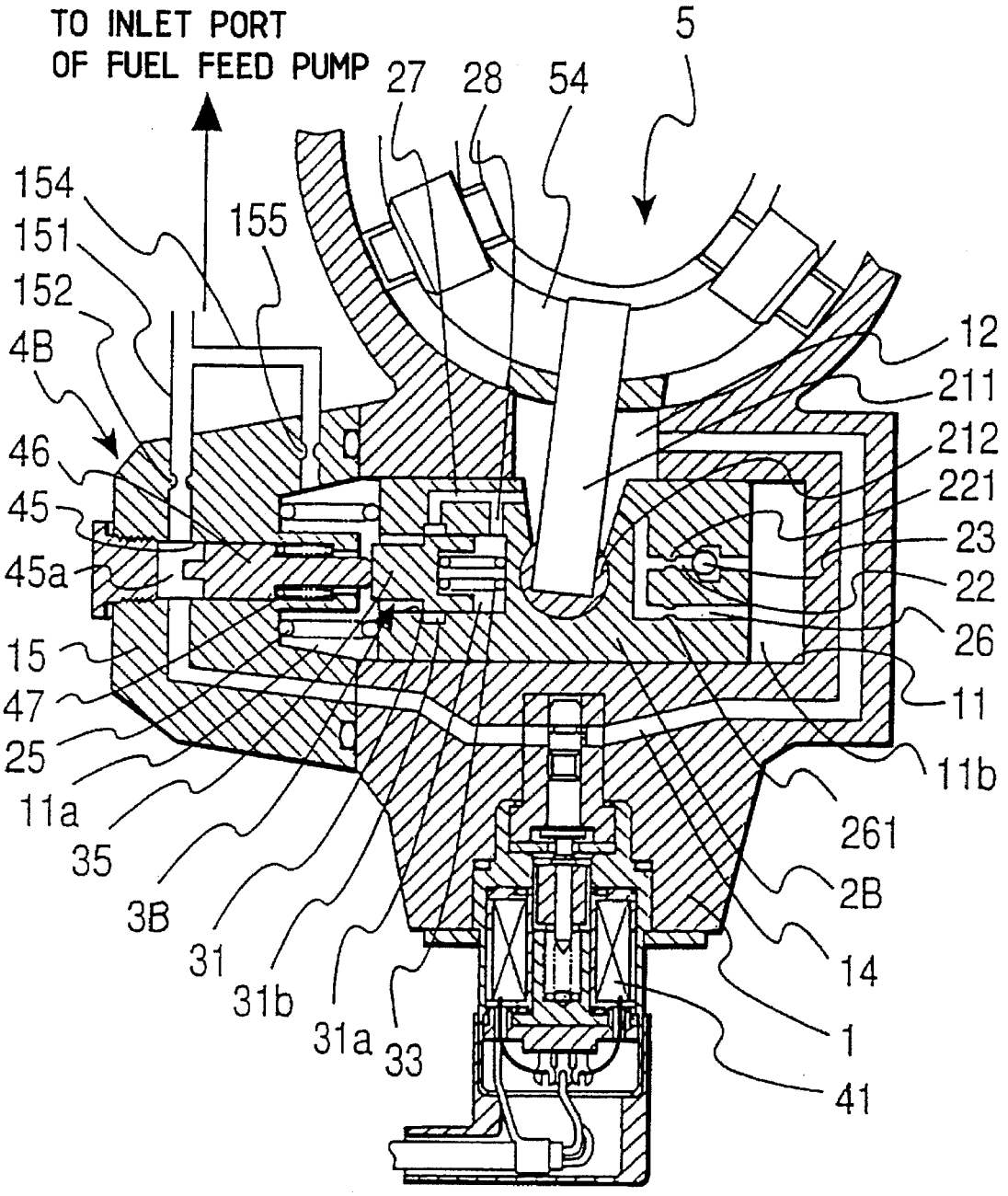
FIG. 8 is a sectional view showing a roller ring drive section of an injection timing control device for a fuel injection pump according to a fourth preferred embodiment of the present invention.

Now, a fourth preferred embodiment of the present invention will be described hereinbelow:

In the fourth preferred embodiment, the timer piston 2A and the servo valve 3A in FIG. 6 are replaced by a timer piston 2B and a servo valve 3B as shown in FIG. 8. The other structure is substantially the same as that in the second preferred embodiment except for provision of a flow restrictor 155 in a passage 154 corresponding to the passage 133. The following explanation manly concerns what differs from the second preferred embodiment.

As shown in FIG. 8, the annular groove 31*b* which is opened and closed by a spool 35 of the servo valve 3B communicates with the connecting opening 12 via a passage 27 formed in the timer piston 2B. The spring chamber 31*a* defined between the spool 35 and the timer piston 2B also communicates with the connecting opening 12 via a passage 28. No passage is provided, as corresponding to the passage 34, for establishing communication between the timer low-pressure chamber 11*a* and the spring chamber 31*a*. The flow restrictor 155 is provided in the passage 154 connecting the timer low-pressure chamber 11*a* to the inlet port of the fuel feed pump 6 (see FIG. 1). Further, a passage 26 with a flow restrictor 261 therein is formed in the timer piston 2B in parallel to the passage 22 for establishing communication between the timer high-pressure chamber 11*b* and the connecting opening 12.

For advancing the fuel injection timing, a duty cycle for opening the oil-pressure control valve 41 is set smaller. With this arrangement, the pressure in the spool control pressure chamber 45*a* is lowered so that the spool 35 and the push rod 46 move toward the spool control pressure chamber 45*a* due to the biasing forces of the springs 33 and 47, thereby fully closing the annular groove 31*b*. As a result, the pressure in the timer low-pressure chamber 11*a* is lowered so that the timer piston 2B moves toward the timer low-pressure chamber 11*a* against the biasing force of the timer spring 25. Thus, the fuel injection timing is advanced as in the foregoing preferred embodiments. On the other hand, for retarding the fuel injection timing, a duty cycle for opening the oil-pressure control valve 41 is set larger. With this arrangement, the pressure in the spool control pressure chamber 45*a* increases so that the push rod 46 pushes the spool 35 to move toward the spring chamber 31*a* against the biasing forces of the springs 33 and 47. Accordingly, the annular groove 31*b* is largely opened to allow the high-pressure fuel to flow into the timer low-pressure chamber 11*a* from the connecting opening 12 via the passage 27 so that the pressure in the timer low-pressure chamber 11*a* is increased. As a result, the timer piston 2B moves toward the timer high-pressure chamber 11*b* to retard the fuel injection timing as in the foregoing preferred embodiments.

In the forgoing manner, the fourth preferred embodiment also provides an effect similar to that in the second preferred embodiment.

Fifth Embodiment

Figure 9:
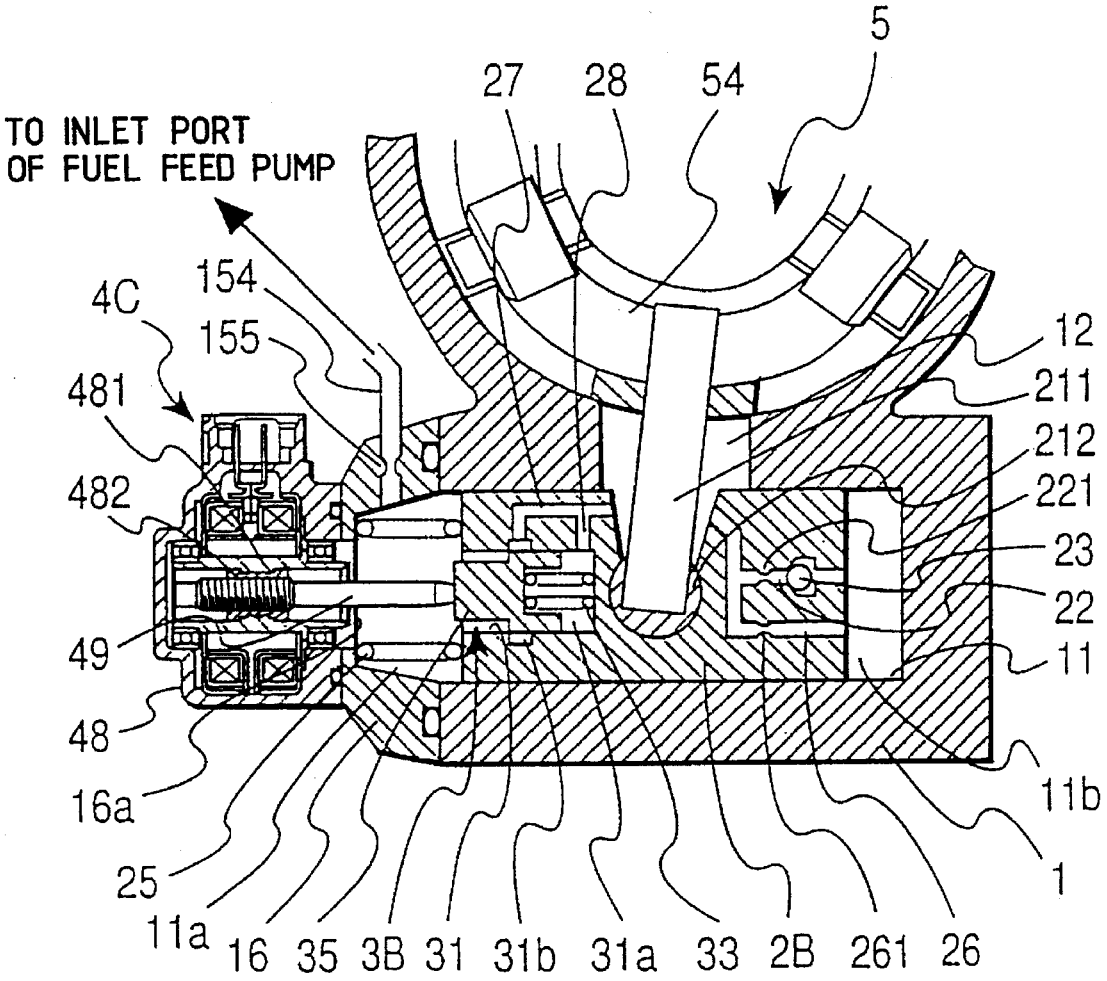
FIG. 9 is a sectional view showing a roller ring drive section of an injection timing control device for a fuel injection pump according to a fifth preferred embodiment of the present invention.
Figure 10:
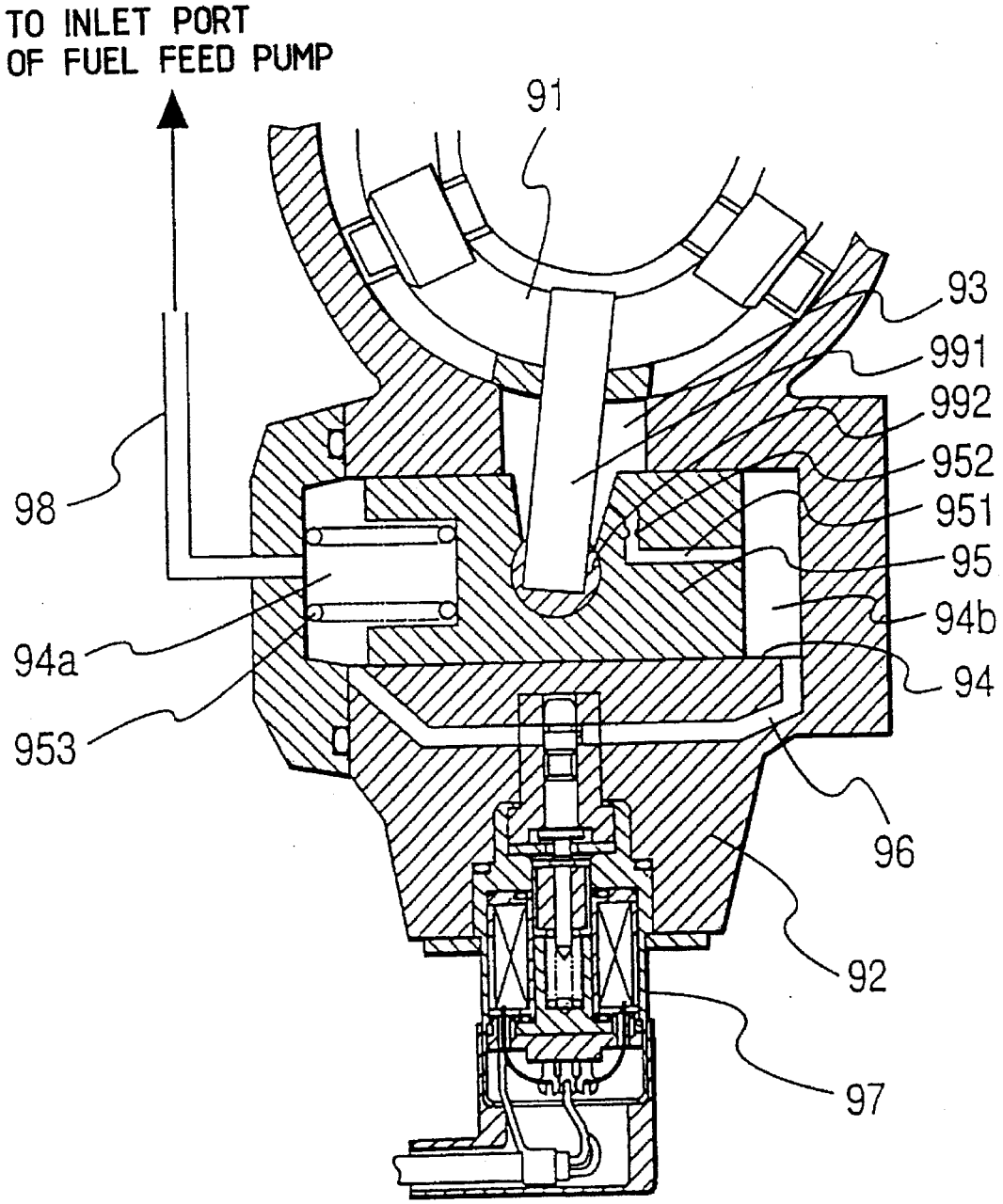
FIG. 10 PRIOR ART
FIG. 10 is a sectional view showing a roller ring drive section of an injection timing control device for a fuel injection pump according to the prior art.

Now, a fifth preferred embodiment of the present invention will be described hereinbelow:

In the fifth preferred embodiment, the timer piston 2A and the servo valve 3A in FIG. 7 are replaced by the timer piston 2B and the servo valve 3B in FIG. 8, as shown in FIG. 9. The other structure is substantially the same as that in the third preferred embodiment except for provision of the flow restrictor 155 in the passage 154 corresponding to the passage 133. The following explanation manly concerns what differs from the third preferred embodiment.

As shown in FIG. 9, like the foregoing fourth preferred embodiment, the flow restrictor 155 is provided in the passage 154 so that the pressure in the timer low-pressure chamber 11*a* becomes higher than the pressure at the inlet port of the fuel feed pump 6 (see FIG. 1), that is, the atmospheric pressure, when the annular groove 31*b* of the servo valve 3B is opened.

For advancing the fuel injection timing, the push rod 49 is retreated toward the stepping motor 48. With this arrangement, the spool 35 moves toward the timer low-pressure chamber 11*a* due to the biasing force of the spring 33 to fully close the annular groove 31*b*. Accordingly, the pressure in the timer low-pressure chamber 11*a* is lowered. Thus, the timer piston 2B moves toward the timer low-pressure chamber 11*a* against the timer spring 25 to advance the fuel injection timing as in the foregoing preferred embodiments. On the other hand, for retarding the fuel injection timing, the push rod 49 is advanced toward the timer piston 2B so as to push the spool 35 to move toward the spring chamber 31*b*. With this arrangement, the annular groove 31*b* is opened to allow the high-pressure fuel to flow into the timer low-pressure chamber 11*a* from the connecting opening 12 via the passage 27. Accordingly, the pressure in the timer low-pressure chamber 11*a* increases to move the timer piston 2B toward the timer high-pressure chamber 11*b*. Thus, the fuel injection timing is retarded as in the foregoing preferred embodiments.

In the forgoing manner, the fifth preferred embodiment also provides an effect similar to that in the third preferred embodiment.

While the present invention has been described in terms of the preferred embodiments, the invention is not to be limited thereto, but can be embodied in various ways without departing from the principle of the invention as defined in the appended claims.

For example, in each of the foregoing preferred embodiments, the fuel injection pump is of a face-cam feeding type. However, it may be of an inner-cam feeding type.

Further, in each of the foregoing preferred embodiments, the passage establishing communication between the timer high-pressure chamber and the annular groove is provided in the timer piston. However, it may be provided in another portion, such as in the housing.

Further, in each of the foregoing preferred embodiments, the cheek valve is provided for preventing the flow-out of fuel from the timer high-pressure chamber. However, it may be omitted when the fuel injection pressure is set low so as to simplify the structure.

Further, in each of the foregoing preferred embodiments, the port open area of the oil-pressure control valve is set smaller relative to the port open area of the servo valve. However, the present invention is not limited thereto. It may be changed depending on a required response characteristic of the fuel injection timing.

Further, in the foregoing third and fifth preferred embodiment, the stepping motor is used. However, a linear motor or the like may be used therefor.

What is claimed is:

1. An injection timing control device for a fuel injection pump, comprising:

a piston slidably received in a cylinder and having an end surface for receiving thereon a pressurized fuel in a first pressure chamber communicating with an outlet side of a fuel feed pump, said piston including a slide hole communicating with a second pressure chamber located opposite to said first pressure chamber with respect to said piston;

a servo valve having a spool slidably received in said slide hole of the piston, said servo valve opening and closing a communication passage, which communicates with said first pressure chamber and opens into said slide hole, by movement of said spool in said slide hole so as to control a fuel pressure in said first pressure chamber to move said piston;

spool operating means for operating said spool; and fuel injection means, mechanically connected to said piston, for changing a fuel injection timing depending on a moved distance of said piston;

wherein, when said piston moves due to a torque reaction force applied thereto while the fuel is injected through said fuel injection means, said communication passage is held closed to prevent movement of the fuel from said pressure chamber.

2. The injection timing control device according to claim 1, wherein said spool includes a slide surface which opens and closes an opening of said communication passage to said slide hole by sliding movement thereof, and wherein said slide surface of the spool holds said communication passage closed when said piston moves due to the torque reaction force applied thereto while the fuel is injected through said fuel injection means.

3. The injection timing control device according to claim 2, wherein said fuel injection means comprises a roller ring having a roller and rotated depending on the moved distance of said piston, and a plunger having a face cam at its base end and rotated by a drive shaft, said plunger achieving an advancing operation every time said face cam rides on said roller of the roller ring, for feeding the fuel under pressure to a fuel injection valve.

4. The injection timing control device according to claim 2, wherein said pressure chamber is provided at each of opposite ends of said piston, wherein a spring for biasing said piston is provided in one of said pressure chambers, and wherein the fuel pressure in said one of the pressure chambers is controlled by said servo valve.

5. The injection timing control device according to claim 4, wherein said one of the pressure chambers communicate with an inlet side of said fuel feed pump via flow restricting means.

6. The injection timing control device according to claim 2, wherein said pressure chamber is provided only at one end of said piston, wherein a low-pressure chamber is provided at the other end of said piston, said low-pressure chamber communicating with an inlet side of said fuel feed pump so as to be constantly held at a given low pressure, and wherein a spring is provided in said low-pressure chamber for biasing said piston toward said pressure chamber.

7. The injection timing control device according to claim 2, wherein a check valve is provided in a passage communicating with said pressure chamber for preventing the fuel from flowing out from said pressure chamber.

8. The injection timing control device according to claim 2, wherein said spool operating means comprises another pressure chamber communicating with an inlet side of said fuel feed pump via flow restricting means, a pressure control valve for controlling a fuel pressure in said another pressure chamber, and a push rod having a diameter smaller than that of said piston and urged by the pressurized fuel in said another pressure chamber to move in its axial direction so as to push said spool at its tip.

9. The injection timing control device according to claim 8, wherein a port open area of said pressure control valve is set smaller than that of said servo valve.

10. The injection timing control device according to claim 2, wherein said spool operating means comprises a push rod operated by a motor to move in its axial directions, and wherein said spool is operated by a tip of said push rod.

11. An injection timing control device for a fuel injection pump, comprising:

a piston slidably received in a cylinder and having an end surface for receiving thereon a pressurized fuel in a first pressure chamber communicating with an outlet side of a fuel feed pump, said piston including a slide hole communicating with a second pressure chamber located opposite to said first pressure chamber with respect to said piston;

a servo valve including a spool slidably received in said slide hole of the piston, said servo valve opening and closing a communication passage, which communicates with said first pressure chamber and opens into said slide hole, by movement of said spool in said slide hole so as to control a fuel pressure in said second pressure chamber to move said piston;

spool operating means for operating said spool; and fuel injection means, mechanically connected to said piston, for changing a fuel injection timing depending on a moved distance of said piston, wherein, when said piston moves due to a torque reaction force applied thereto while the fuel is injected through said fuel injection means, movement of said piston is canceled by opening said communication passage so as to prevent movement of the fuel from said first pressure chamber.

12. The injection timing control device according to claim 11, wherein said spool includes a slide surface which opens and closes an opening of said communication passage to said slide hole by sliding movement thereof, and wherein said slide surface of the spool cancels the movement of said piston by opening said communication passage when said piston moves due to the torque reaction force applied thereto while the fuel is injected through said fuel injection means.

13. The injection timing control device according to claim 12, wherein said fuel injection means comprises a roller ring including a roller and rotated depending on the moved distance of said piston, and a plunger including a face cam at its base end and rotated by a drift shaft, said plunger achieving an advancing operating every time said face cam rides on said roller of the roller ring, for feeding the fuel under pressure to a fuel injection valve.

14. The injection timing control device according to claim 12, wherein said pressure chamber is provided at each of opposite ends of said piston, wherein a spring for biasing said piston is provided in one of said pressure chambers, and wherein the fuel pressure in said one of the pressure chambers is controlled by said servo valve.

15. The injection timing control device according to claim 14, wherein said one of the pressure chambers communicate with an inlet side of said fuel pump via flow restricting means.

16. The injection timing control device according to claim 12, wherein said pressure chamber is provided only at one end of said piston, wherein a low-pressure chamber is provided at the other end of said piston, said low-pressure chamber communicating with an inlet side of said fuel feed pump so as to be constantly held at a given low pressure, and wherein a spring is provided in said low-pressure chamber for biasing said piston toward said pressure chamber.

17. The injection timing control device according to claim 12, wherein a check valve is provided in a passage communicating with said pressure chamber for preventing the fuel from flowing out from said pressure chamber.

18. The injection timing control device according to claim 12, wherein said spool operating means comprises another pressure chamber communicating with an inlet side of said fuel feed pump via flow restricting means, a pressure control valve for controlling a fuel pressure in said another pressure chamber, and a push rod having a diameter smaller than that of said piston and urged by the pressurized fuel in said another pressure chamber to move in its axial direction so as to push said spool at its tip.

19. The injection timing control device according to claim 18, wherein a port open area of said pressure control valve is set smaller than that of said servo valve.

20. The injection timing control device according to claim 12, wherein said spool operating means comprises a push rod operated by a motor to move in its axial directions, and wherein said spool is operated by a tip of said push rod.

21. An injection timing control device for a fuel injection pump, comprising:

a piston slidably received in a cylinder and having at least one end surface for receiving thereon a pressurized fuel in a pressure chamber communicating with an outlet side of a fuel feed pump;

a servo valve including a spool, said spool communicating with said pressure chamber and controlling a fuel pressure in said pressure chamber so as to move said piston;

spool operating means for operating said spool; and fuel injection means, mechanically connected to said piston, for changing a fuel injection timing depending on a moved distance of said piston, wherein a check valve is provided in a passage communicating with said pressure chamber, said check valve closing said pressure chamber when said piston moves due to a torque reaction force applied thereto while the fuel is injected through said fuel injection means, so as to prevent movement of the fuel from said pressure chamber.

22. The injection timing control device according to claim 21, wherein a flow resistor having a smaller diameter than said passage is provided in said passage between said check valve and said fuel injection means.

* * * * *